US012747644B2

(12) United States Patent
Mydland et al.

(10) Patent No.: US 12,747,644 B2
(45) Date of Patent: Sep. 29, 2026

(54) DRILLING SYSTEM AND METHOD OF OPERATING A DRILLING SYSTEM

(71) Applicant: MHWIRTH AS, Kristiansand S (NO)

(72) Inventors: Petter Mydland, Kristiansand S (NO); Erland Nyjordet, Grimstad (NO)

(73) Assignee: MHWIRTH AS, Kristiansand S (NO)

( * ) Notice: Subject to any disclaimer, the term of this patent is extended or adjusted under 35 U.S.C. 154(b) by 0 days.

(21) Appl. No.: 19/132,830

(22) PCT Filed: Nov. 6, 2023

(86) PCT No.: PCT/NO2023/060085
§ 371 (c)(1),
(2) Date: May 26, 2025

(87) PCT Pub. No.: WO2024/117912
PCT Pub. Date: Jun. 6, 2024

(65) Prior Publication Data
US 2026/0193945 A1 Jul. 9, 2026

(30) Foreign Application Priority Data
Nov. 28, 2022 (NO) ..... 20221278

(51) Int. Cl.
*E21B 19/10* (2006.01)
*E21B 41/00* (2006.01)

(52) U.S. Cl.
CPC ..... *E21B 19/10* (2013.01); *E21B 41/0021* (2013.01)

(58) Field of Classification Search
CPC ..... E21B 19/10; E21B 41/0021
See application file for complete search history.

(56) References Cited

U.S. PATENT DOCUMENTS

| | | | | |
|---|---|---|---|---|
| 10,774,600 | B2 * | 9/2020 | Zouhair | E21B 19/07 |
| 2004/0188098 | A1 * | 9/2004 | Schulze-Beckinghausen | E21B 44/02 166/380 |
| 2013/0098606 | A1 * | 4/2013 | Webre | E21B 17/026 166/380 |
| 2013/0186640 | A1 * | 7/2013 | Webre | E21B 19/08 166/85.5 |
| 2015/0167446 | A1 * | 6/2015 | Taskinen | E21B 19/10 166/382 |
| 2016/0290073 | A1 * | 10/2016 | Zheng | E21B 44/00 |
| 2018/0051526 | A1 * | 2/2018 | Zouhair | E21B 19/07 |
| 2018/0149016 | A1 * | 5/2018 | Martin | E21B 41/0021 |
| 2019/0100988 | A1 * | 4/2019 | Ellis | G01B 11/043 |
| 2021/0102454 | A1 * | 4/2021 | Jorud | G06Q 50/265 |
| 2022/0186571 | A1 * | 6/2022 | Lien | B25J 15/0253 |
| 2022/0290513 | A1 * | 9/2022 | Zheng | E21B 19/165 |
| 2022/0307333 | A1 * | 9/2022 | Gomez | E21B 19/10 |
| 2022/0341309 | A1 * | 10/2022 | Braniff | G08B 21/187 |
| 2024/0018834 | A1 * | 1/2024 | Baker | E21B 19/10 |
| 2026/0009298 | A1 * | 1/2026 | Stankovic | E21B 19/10 |

* cited by examiner

*Primary Examiner* — Shane Bomar
(74) *Attorney, Agent, or Firm* — Norman B. Thot

(57) ABSTRACT

A drilling system includes a hoisting system, a slips arrangement, and a sensor. The hoisting system holds and suspends a tubular string through an opening in a drill floor. The slips arrangement has a body positioned in the opening and at least one wedge-shaped slips member which is movable within the body and operable to engage the tubular string. The sensor monitors a vertical position of the body of the slips arrangement relative to the drill floor.

11 Claims, 7 Drawing Sheets

DRILLING SYSTEM AND METHOD OF OPERATING A DRILLING SYSTEM

CROSS REFERENCE TO PRIOR APPLICATIONS

This application is a U.S. National Phase application under 35 U.S.C. § 371 of International Application No. PCT/NO2023/060085, filed on Nov. 6, 2023 and which claims benefit to Norwegian Patent Application No. 20221278, filed on Nov. 28, 2022. The International Application was published in English on Jun. 6, 2024 as WO 2024/117912 A1 under PCT Article 21(2).

FIELD

The present application relates to drilling systems and to methods of operating a drilling system, including but not limited to systems and methods for a safe and operationally reliable handling of a tubular pipe extending into a wellbore.

BACKGROUND

During drilling operations, for example, drilling carried out for petroleum exploration and exploitation, it is common to handle various tubulars used or installed in a wellbore with the aid of a drilling plant. The drilling plant is commonly arranged at ground level directly above the well or, in the case of offshore wells, on a platform or a floating vessel, such as a semi-submersible rig or a drillship. Such tubulars may include drill pipe, well casing, or other types of tubular pipe used in operations relating to creating or preparing the borehole. The drilling plant commonly comprises a dedicated hoisting system for this purpose, usually having a travelling assembly which carries the tubular string and raises or lowers the string into or out of the well. Such hoisting systems may, for example, be winch-based systems (e.g., using so-called drawworks) with a multiple stringed block, such as that described in WO 2013/076207 A2 and WO 2014/209131 A1. An alternative solution is a cylinder lifting rig, such as RamRig™ technology. An example of a possible arrangement is described in WO 97/23705 A1. A slips arrangement is commonly arranged at a drill floor in order to hang off a pipe string during such operations.

EP 3 176 363 A1 describes a tubular handling tool with an electronic control system, a sensor, and a controller which is configured to control the actuation of the tubular handling tool in response to an electronic signal corresponding to an operational characteristic of the tubular handling tool. Other documents which may be useful for understanding the field of technology of the present invention include EP 1332272 A1, US 2015/0315855 A1, US 2009/0292542 A1, U.S. Pat. No. 8,567,512 B2, U.S. Pat. No. 4,748,563 A, and US 2015/0167446 A1.

A safe and reliable operation is of utmost importance when handling such tubular pipe extending into the wellbore in drilling plants. Irregularities in the pipe handling may, for example, compromise health and safety on the drill floor. Significant extra costs may also be incurred, both due to direct damage and delays, in the case of damage to the pipe, associated equipment, and/or to the well.

There is therefore a continuous need for improved systems and methods for safe and reliable handling of pipes in wellbore operations.

SUMMARY

An aspect of the present invention is to provide such improved systems and methods which have advantages over known solutions and techniques.

In an embodiment, the present invention provides a drilling system which includes a hoisting system, a slips arrangement, and a sensor. The hoisting system is operable to hold and suspend a tubular string through an opening in a drill floor. The slips arrangement comprises a body which is positioned in the opening, and at least one wedge-shaped slips member which is configured to be movable within the body and operable to engage the tubular string. The sensor is configured to monitor a vertical position of the body of the slips arrangement relative to the drill floor.

BRIEF DESCRIPTION OF THE DRAWINGS

The present invention is described in greater detail below on the basis of embodiments and of the drawings in which.

DETAILED DESCRIPTION

In an embodiment, the present invention provides a drilling system comprising a hoisting system which is operable to hold and suspend a tubular string through an opening in a drill floor; a slips arrangement, the slips arrangement comprising a body positioned in the opening and at least one wedge-shaped slips member movable within the body and operable to engage the tubular string; and a sensor which is configured to monitor the vertical position of the body of the slips arrangement relative to the drill floor.

In an embodiment, the present invention provides a method of operating a drilling system comprising the steps: suspending a tubular string from a hoisting system through a slips arrangement positioned in an opening on a drill floor, the slips arrangement comprising a body and at least one wedge-shaped slips member movable within the body and operable to engage the tubular string; and operating a sensor to provide a signal, the signal being representative of a vertical position of the body of the slips arrangement relative to the drill floor.

The above and other characteristics will become clear from the following description of illustrative, non-restrictive examples, with reference to the attached drawings.

Figure 1:
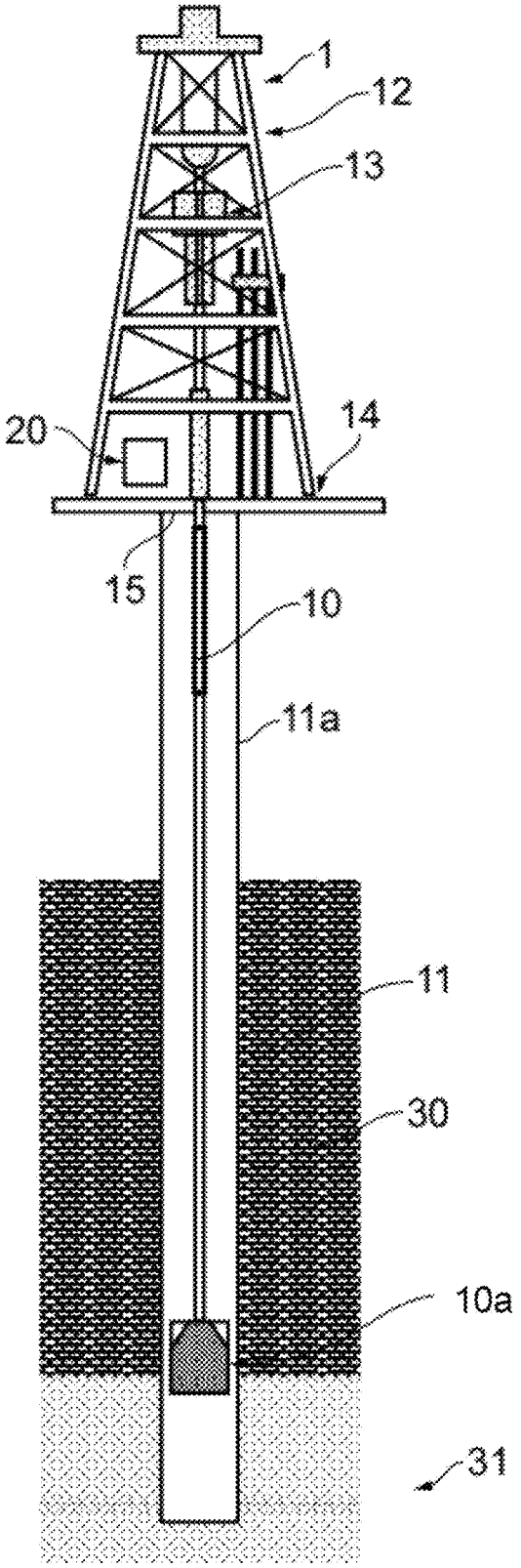
FIG. 1 schematically illustrates a drilling plant arranged in conjunction with a wellbore where the wellbore is connected to the well center opening on the drill floor via a riser.
Figure 2:
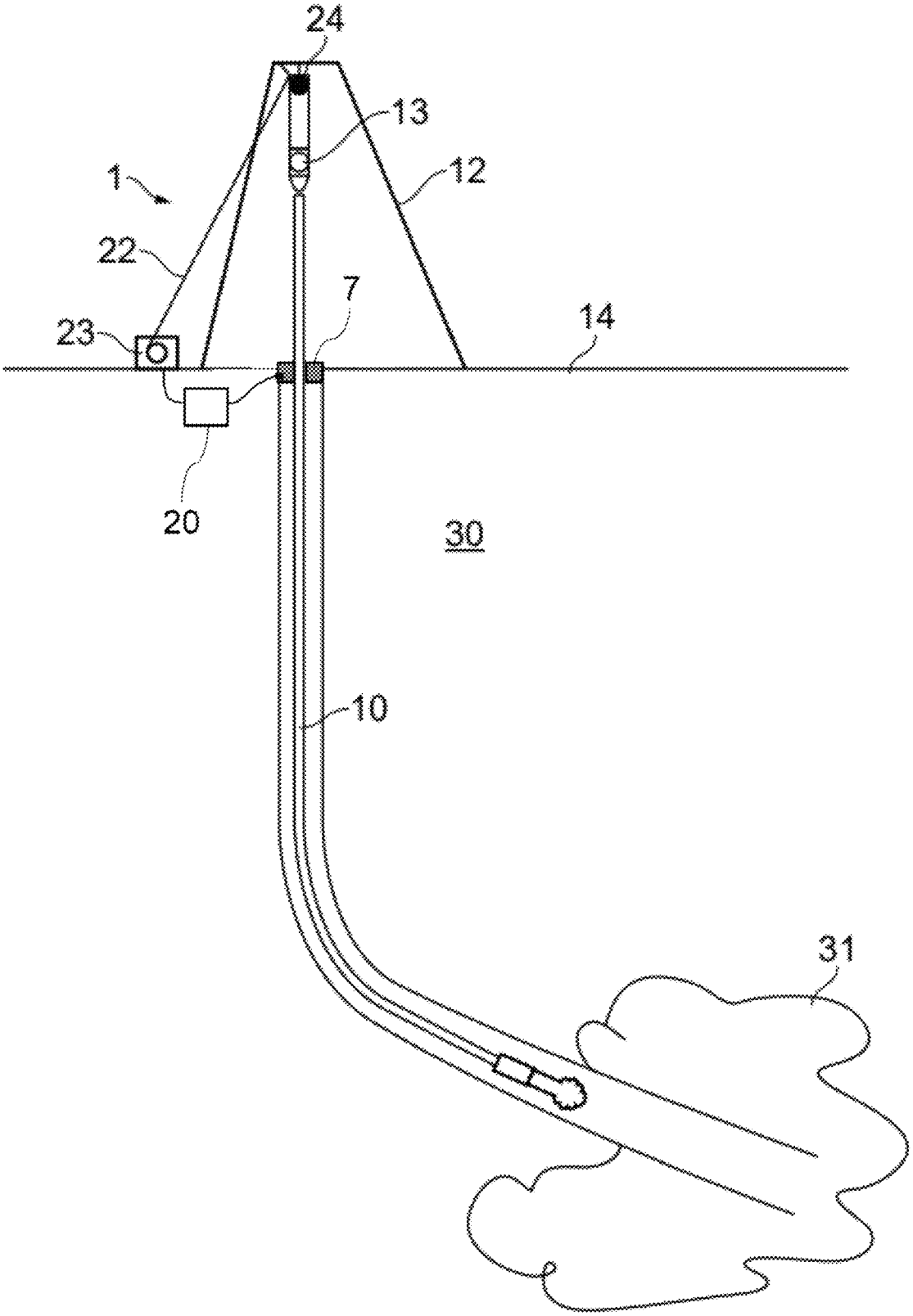
FIG. 2 schematically illustrates a drilling plant arranged in conjunction with a wellbore where the wellbore is connected to the well center opening on the drill floor directly.

A drilling plant according to an embodiment is illustrated in FIGS. 1 and 2. The drilling plant comprises a derrick structure 12 which is arranged in conjunction with a drill floor 14. A hoisting system 1 is provided in relation to the derrick structure 12, the hoisting system 1 in this embodiment comprising a winch 23, a travelling assembly 13, and a crown block 24. A wire 22 extends from the winch 23, via multiple sheaves in the crown block 24 and a travelling block forming part of the traveling assembly 13 so as to suspend the travelling assembly 13 vertically above a well center opening 15 in the drill floor 14. In alternative embodiments, the hoisting system 1 may be based on a cylinder hoisting arrangement, as noted above.

A wellbore 11 extends through a subterranean formation 30 towards a petroleum reservoir 31. The wellbore 11 is connected to the well center opening 15 on the drill floor 14 via a riser 11*a*, as illustrated in FIG. 1, or directly, as shown in FIG. 2. A drill string 10 having a drill bit 10*a* at a lower end section thereof (or another elongate element) can thus be suspended from the travelling assembly 13 and extended downwards into the wellbore 11 to make new hole or to carry out other operations downhole. The skilled reader will recognize the above setup as a conventional drilling plant arrangement for offshore and land-based wells, respectively.

Figure 3:
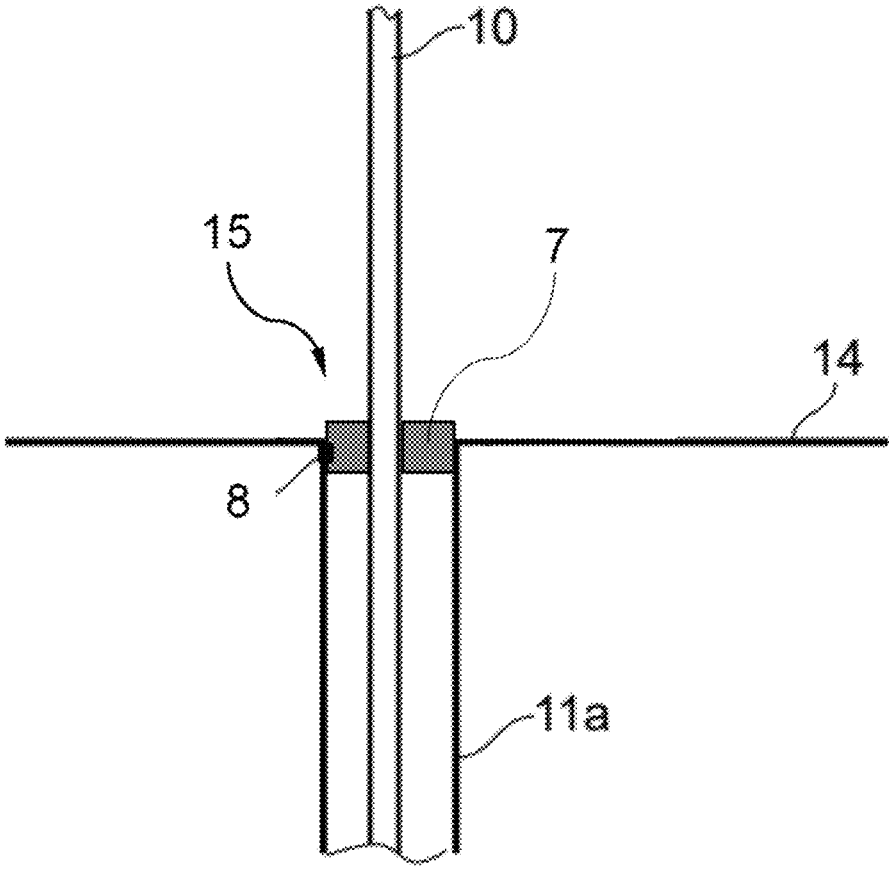
FIG. 3 illustrates a part of a drilling plant, including a drill floor and a slips arrangement, where a sensor is integrated with the drill floor with the slips arrangement.
Figure 4:
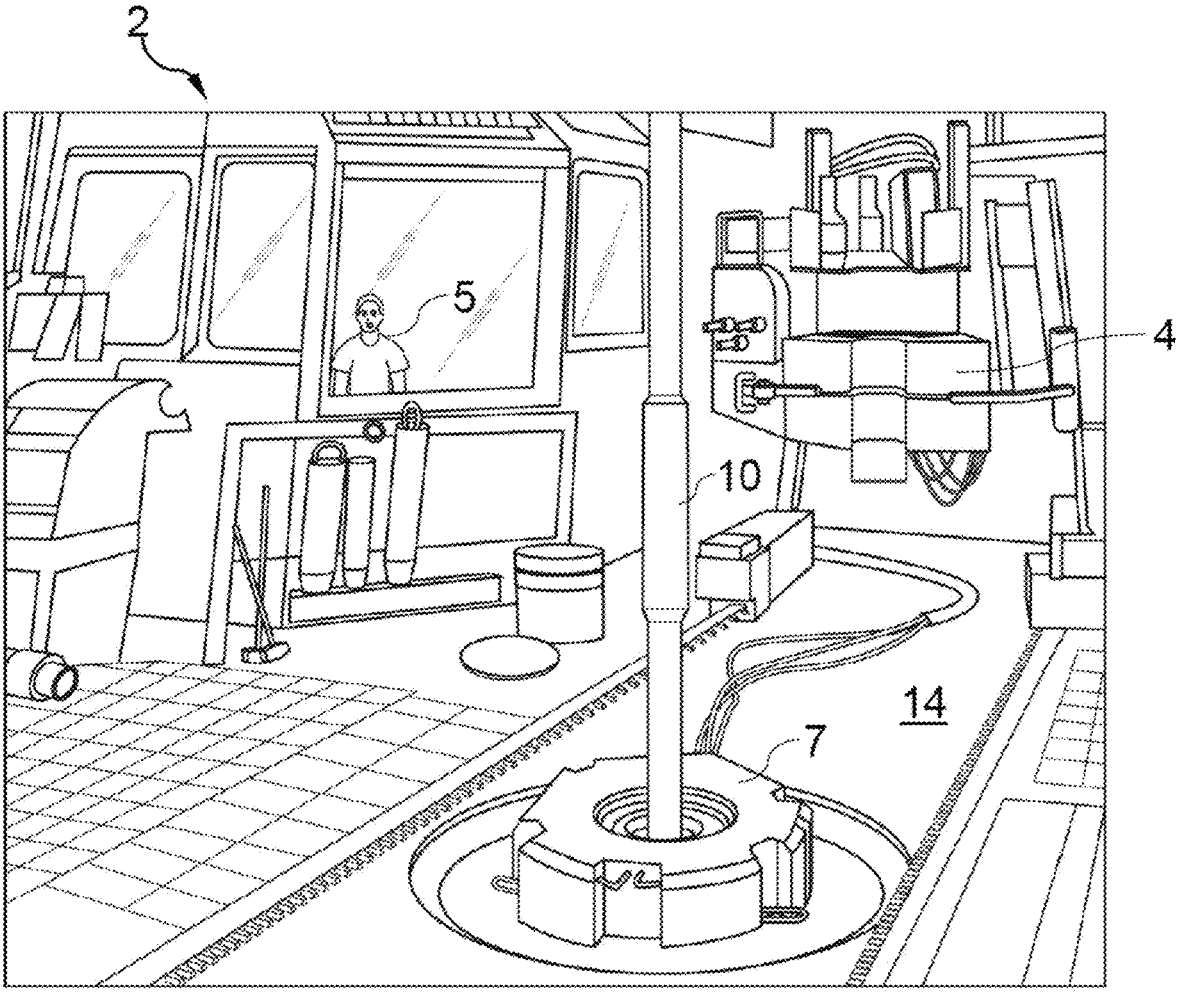
FIG. 4 illustrates parts of a drilling plant, including a drill floor and a slips arrangement.
Figure 5:
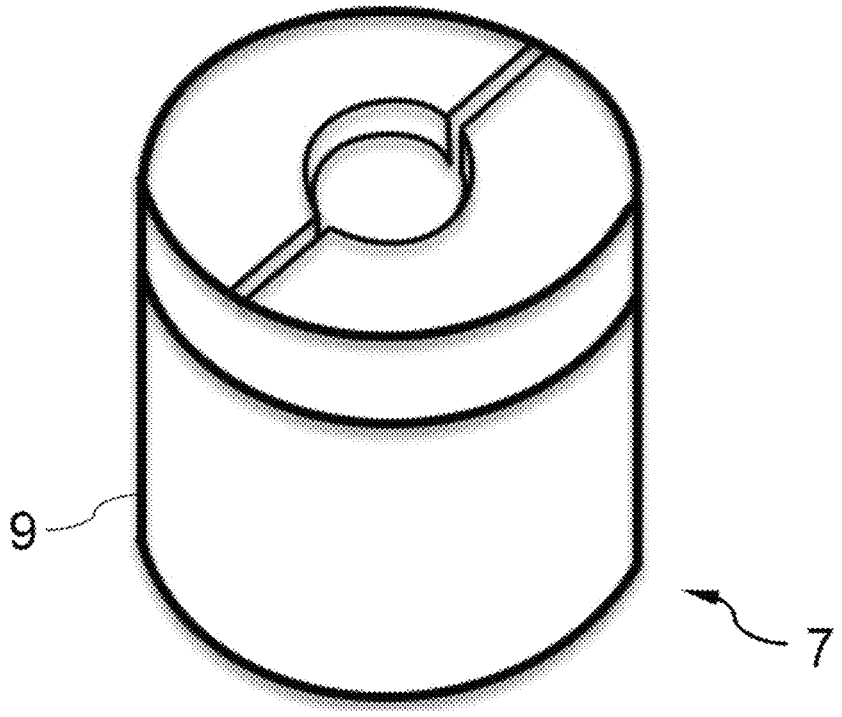
FIG. 5 shows a perspective view of a slips arrangement having a body and slips members.
Figure 6:
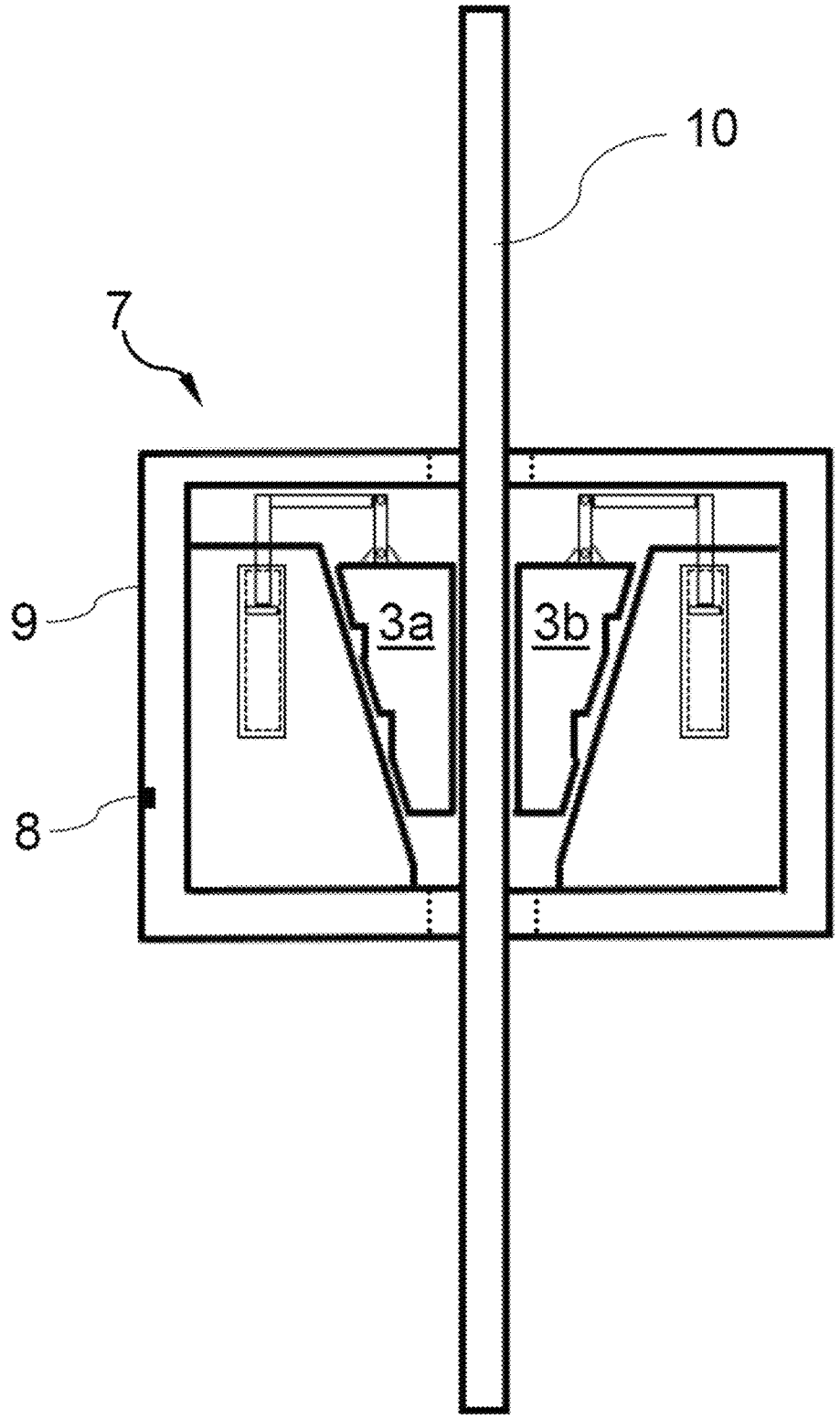
FIG. 6 shows a cross sectional view of a slips arrangement where the slips members are wedge-shaped locking members which are operable to selectively engage the tubular string.

FIG. 2 shows a slips arrangement 7 which is arranged in the well center opening 15. FIGS. 3 and 4 illustrate in more detail the arrangement of the slips arrangement 7 on the drill floor 14, and FIGS. 5 and 6 illustrate an example of a slips arrangement 7. The slips arrangement 7 comprises a body 9 positioned in the well center opening 15 and at least one slips member 3*a,b* which is movable inside the body 9 and which is operable to engage the drill string 10. The slips members 3*a,b* may be wedge-shaped locking members which are operable to selectively engage the drill string 10, as illustrated schematically in FIG. 6.

The slips arrangement 7 is used for suspending the drill string 10, for example, between make-up or break-out operations of the drill string 10, where the drill string 10 is hung off in the slips arrangement 7 by bringing the slips members 3*a,b* into engagement with the drill string 10 so as to vertically support the drill string 10 and carry the weight thereof.

The body 9 is supported by the drill floor 14, for example, in a dedicated receiver, receptacle, or profile arranged in or in conjunction with the well center opening 15.

An important aspect of the present invention is that a risk for personnel injury and/or equipment damage exists in the event of an undesirable scenario that the hoisting system 1 is operated to lift the drill string 10 while the slips members 3*a,b* are closed around the drill string 10, or while the slips members 3*a,b* are not fully in the open position. This may, for example, be the case if a drilling operator 5 forgets to give a command to open the slips members 3*a,b* before operating the hoisting system 1 to lift the drill string 10, or in the event that an actuation mechanism in the slips arrangement 7 fails to open the slips members 3*a,b* correctly, e.g., due to actuator malfunction, dirt/foreign objects in the mechanism, or other factors.

In such an event, the slips arrangement 7 may unintentionally be lifted out of its position relative to the drill floor 14 together with the drill string 10, which can create health-and-safety (HSE) risks for personnel present at the drill floor 14, and/or damage to the slips arrangement 7 itself and/or other machines, such as a power tong 4 (see FIG. 4) being used to make up or break out connections on the drill string 10.

The present invention provides a sensor 8 which is configured to monitor the vertical position of the body 9 of the slips arrangement 7 relative to the drill floor 14. The sensor 8, illustrated schematically in FIGS. 3 and 6, may be integrated with the drill floor 14, integrated with the slips arrangement 7 (for example, being arranged in the body 9 as illustrated in FIG. 6), or be positioned elsewhere. The sensor 8 may, for example, be a contact sensor, a magnetic sensor, a force sensor, or any other suitable type. The sensor 8 may, for example, measure the weight force(s) or presence/contact between the slips arrangement 7 and the receiver or receptacle in which it is supported at the drill floor 14, and register if the slips arrangement 7 is lifted off its support or out of the receiver/receptacle. The sensor 8 may also, for example, be spaced from the well center opening 15 and the slips arrangement 7. The sensor 8 could, for example, be an optical sensor, a radar sensor, an ultrasonic sensor, a camera/machine vision system configured for visual detection of the position of the slips arrangement 7, a laser sensor, or the like which registers a vertical movement of the slips arrangement 7, or other types of remote sensors.

A potential risk associated with unintentional lifting of the slips arrangement 7 relative to the drill floor 14 can thereby be identified and appropriate action taken.

The system may comprise a controller 20 (see FIG. 2) which is operatively connected to the sensor 8 and to the hoisting system 1, where the controller 20 is configured to automatically alter the operation of the hoisting system 1 if vertical movement between the body 9 of the slips arrangement 7 and the drill floor 14 is detected by the sensor 8. In FIG. 2, the controller 20 is illustrated in one example where the controller 20 is connected to the sensor 8 arranged at or adjacent the slips arrangement 7 and also operatively connected to the winch 23 so as to control the operation of the winch 23. The controller 20 can alternatively be operatively connected to, for example, hoisting cylinders or other parts of the hoisting system 1.

In response to the detection of a vertical movement between the body 9 of the slips arrangement 7 and the drill floor 14, the controller 20 may, for example, be configured to, (i) reduce a hoisting speed of the hoisting system 1, (ii) impose a maximum limit on the hoisting speed of the hoisting system 1, or (iii) stop the hoisting system 1. Automatic action can thereby be taken to reduce or eliminate the risk for damage or further damage, for example, by preventing or restricting a further hoisting of the drill string 10 if such movement of the slips arrangement 7 has been detected.

Figure 7:
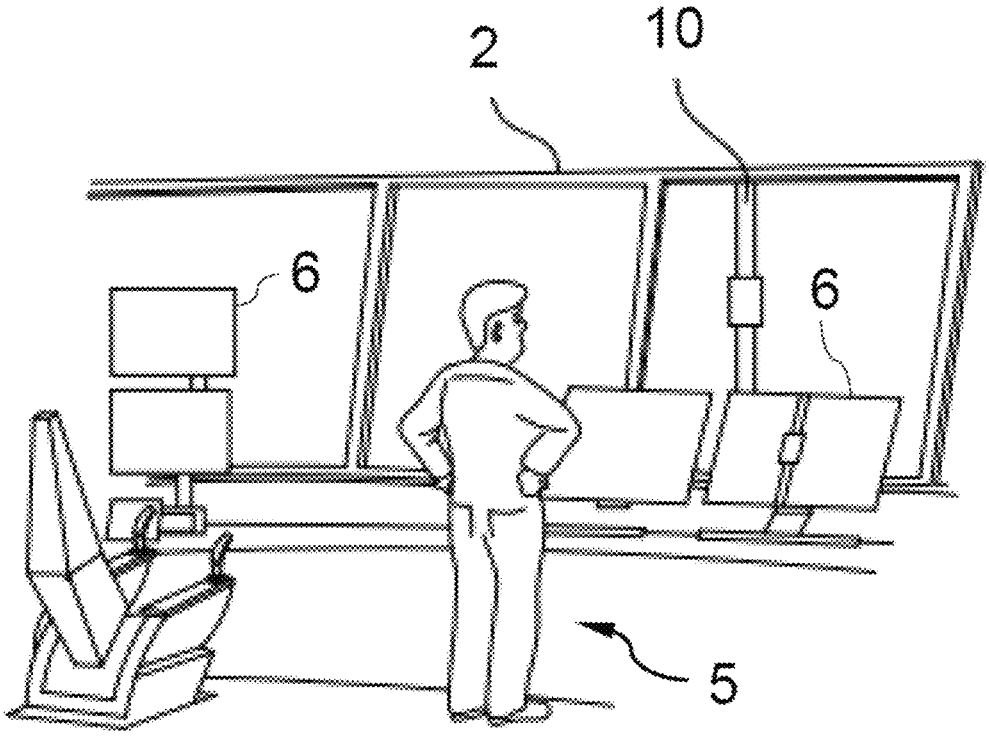
FIG. 7 illustrates a driller cabin and components thereof.

The controller 20 may form part of an overall drilling monitoring and management system, and may, for example, include a display 6 for displaying relevant information to the drilling operator 5 (see FIG. 7).

An alert device can alternatively or additionally be operatively connected to the sensor 8 and configured to issue an alert if vertical movement of the slips arrangement 7 has been detected by the sensor 8. The alert may, for example, be an audible alert such as an alarm producing noise and/or a visual alert, such as a warning message on an operator display. FIG. 7 shows that the alert may be issued to a drilling operator 5 in a driller cabin 2 on respective displays 6, which may in such a case function as the alert device. The drilling operator 5 may thereby be provided with immediate notification of an irregular incident in which movement between the body 9 of the slips arrangement 7 and the drill floor 14 has been detected. The drilling operator 5 may take corrective action to halt a further hoisting of the drill string 10, lower the drill string 10 and arrange to position the slips arrangement 7 back into its intended position, and/or take further action such as to initiate damage inspection in response to the incident. The alert device may be operatively connected to the controller 20 and the controller 20 may be arranged to trigger the alert.

According to embodiments described herein, it is possible to obtain warning of an irregular and unintended situation occurring or having occurred, which allows corrective action(s) to be taken. The risk of injury or damage in the event of human errors or operational irregularities in equipment can thus be reduced.

The present invention is not limited by the embodiments described above; reference should be had to the appended claims.

LIST OF REFERENCE NUMERALS

1 Hoisting system
2 Driller cabin
3*a* Slips member
3*b* Slips member
4 Power tong
5 Drilling operator
6 Display
7 Slips arrangement
8 Sensor
9 Body
10 Drill string
10*a* Drill bit
11 Wellbore
11*a* Riser
12 Derrick structure
13 Travelling assembly
14 Drill floor
15 Well center opening
20 Controller
22 Wire
23 Winch
24 Crown block
30 Subterranean formation
31 Petroleum reservoir

What is claimed is:

1. A drilling system comprising:

a hoisting system which is operable to hold and suspend a tubular string through an opening in a drill floor;

a slips arrangement comprising a body which is positioned in the opening, and at least one wedge-shaped slips member which is configured to be movable within the body and operable to engage the tubular string; and a sensor which is configured to monitor a vertical position of the body of the slips arrangement relative to the drill floor.

2. The drilling system as recited in claim 1, further comprising:

a controller which is operatively connected to the sensor and to the hoisting system, the controller being configured to automatically modify an operation of the hoisting system if a vertical movement between the body of the slips arrangement and the drill floor is detected by the sensor.

3. The drilling system as recited in claim 2, wherein, in response to the detection by the sensor of the vertical movement between the body of the slips arrangement and the drill floor, the controller is further configured to, reduce a hoisting speed of the hoisting system, impose a maximum limit on the hoisting speed of the hoisting system, or stop the hoisting system.

4. The drilling system as recited in claim 1, further comprising:

an alert device which is operatively connected to the sensor, the alert device being configured to issue an alert to a drilling operator if a vertical movement between the body of the slips arrangement and the drill floor is detected by the sensor.

5. The drilling system as recited in claim 4, wherein the alert is an audible alert or a visual alert.

6. The drilling system as recited in claim 1, wherein the sensor is arranged, in the body of the slips arrangement, in or at the drill floor, or spaced from the opening.

7. A method of operating a drilling system, the method comprising:

suspending a tubular string from a hoisting system through a slips arrangement which is positioned in an opening on a drill floor, the slips arrangement comprising a body and at least one wedge-shaped slips member which is movable within the body and operable to engage the tubular string; and operating a sensor to provide a signal, the signal being representative of a vertical position of the body of the slips arrangement relative to the drill floor.

8. The method as recited in claim 7, further comprising:

automatically modifying an operation of the hoisting system in response to a vertical movement between the body of the slips arrangement and the drill floor detected by the sensor using a controller which is operatively connected to the sensor and to the hoisting system.

9. The method as recited in claim 8, wherein, in response to the vertical movement between the body of the slips arrangement and the drill floor detected by the sensor, the method further comprises:

operating the controller to, reduce a hoisting speed of the hoisting system, impose a maximum limit on the hoisting speed of the hoisting system, or stop the hoisting system.

10. The method as recited in claim 7, further comprising:

operating an alert device to issue an alert to a drilling operator in response to a vertical movement between the body of the slips arrangement and the drill floor detected by the sensor.

11. The drilling system as recited in claim 10, wherein the alert is an audible alert or a visual alert.

* * * * *